US005602534A

United States Patent [19]

Granat

[11] Patent Number: 5,602,534

[45] Date of Patent: Feb. 11, 1997

[54] ELECTRICALLY CONDUCTIVE HOUSING FOR AN ELECTRONIC COMPONENT, ESPECIALLY A DEFLECTION SENSOR AND A SECURITY FENCE ALARM SYSTEM FOR USE THEREWITH

[75] Inventor: Baruch Granat, Rishon Le-Zion, Israel

[73] Assignee: Granat-The Israeli Security Center Ltd., Israel

[21] Appl. No.: 497,386

[22] Filed: Jun. 30, 1995

[30] Foreign Application Priority Data

Jul. 1, 1994 [IL] Israel ..... 110186

[51] Int. Cl.[6] ..... G08B 13/12

[52] U.S. Cl. ..... 340/693; 174/51; 340/541; 340/665; 340/668; 361/817

[58] Field of Search ..... 340/693, 666, 340/668, 665, 541; 174/52.1, 51, 50; 361/816

[56] References Cited

U.S. PATENT DOCUMENTS 3,832,704 8/1974 Kardashian ..... 340/541
5,392,027 2/1995 Brunot et al. ..... 340/561

*Primary Examiner*—Glen Swann
*Attorney, Agent, or Firm*—Leonard Bloom

[57] ABSTRACT

An electrically conductive housing completely envelops an electronic component so as to screen the electronic component from electromagnetic radiation whilst permitting movement of the electronic component relative to the housing when acted upon by an external force. According to a preferred embodiment, the electronic component is a deflection sensor or taut wire sensor for use in an electrical security fence, such that the sensor is completely shielded from the atmospheric effects and stray radiation.

27 Claims, 7 Drawing Sheets

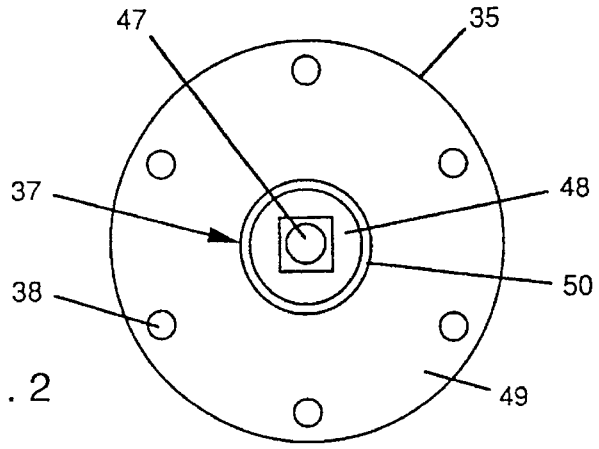
Fig. 2
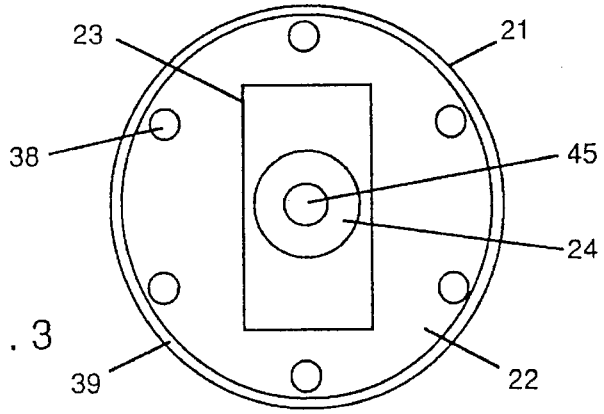
Fig. 3
Fig. 4
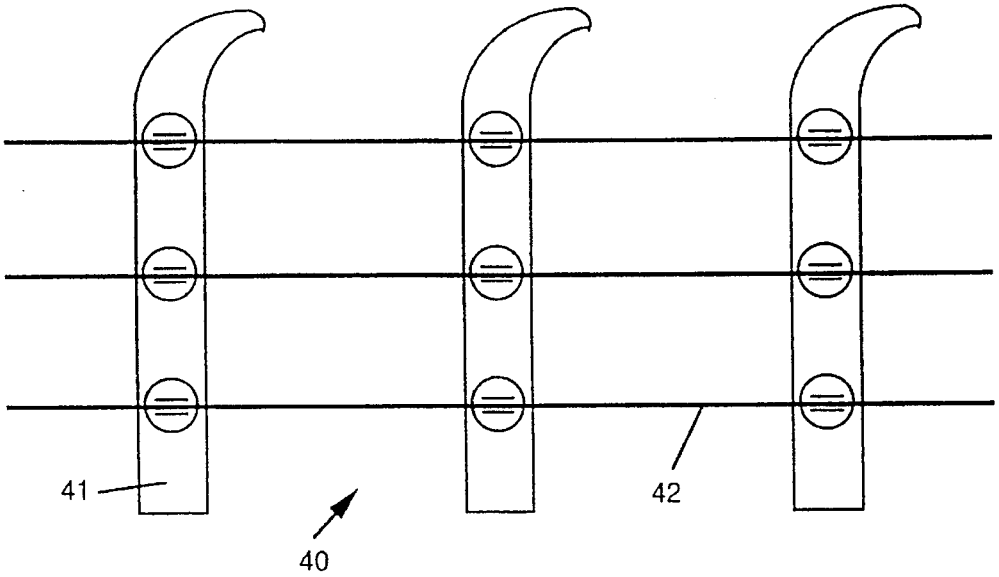

ELECTRICALLY CONDUCTIVE HOUSING FOR AN ELECTRONIC COMPONENT, ESPECIALLY A DEFLECTION SENSOR AND A SECURITY FENCE ALARM SYSTEM FOR USE THEREWITH

FIELD OF THE INVENTION

This invention relates to a deflection sensor, particularly one adapted for use with security fences and the like, and to a security fence alarm system for use therewith.

BACKGROUND OF THE INVENTION

Perimeter fences are known having intruder alarms in the form of deflection sensors fixed to the fence posts and having the fence wires fixedly mounted thereto. Unauthorized tampering with the fence wires causes deformation of the deflection sensors attached thereto and permits such tampering to be detected and monitored. By such means it is possible not only to determine the act of attempted intrusion but also its location.

International Patent publication No. WO 9,309,521 in the name of Vindicator Corporation discloses a strain gauge deflection sensor having a flexible housing connected at one end to a support and at the other end to a taut wire of a perimeter fence. The interior of the housing contains a full bridge strain gauge having a circuit board carrying four strain gauge elements and an amplifier for the differential voltage obtained from the bridge circuit corresponding to flexure of the circuit board upon deflection of the taut wire. The output from the amplifier is fed to a data processing system providing an alarm signal.

Such deflection sensors are in common use but suffer from the drawback that they are subject to stray ambient electromagnetic radiation which can produce an intrusion signal even when no attempted intrusion is taking place. The only way to avoid the undesirable effect of such stray radiations has, so far, been to decrease the overall sensitivity of the strain gauge circuit but this solution militates against their use in very high security perimeter fences where extreme sensitivity is required.

SUMMARY OF THE INVENTION

It is an object of the invention to overcome the effects of stray ambient radiation in a deflection sensor of the kind described without decreasing its overall sensitivity.

According to a broad aspect of the invention there is provided an electrically conductive housing for completely enveloping an electronic component so as to screen the electronic component from electromagnetic radiation whilst permitting movement of the electronic component relative to the housing when acted upon by an external force. In accordance with a preferred embodiment of the invention, the electronic component is a deflection sensor which is enveloped in an electrically conductive housing so as to screen the deflection sensor from electromagnetic radiation whilst permitting deformation of the deflection sensor when acted upon by an external force.

According to a preferred embodiment of the invention, the housing comprises:

a base portion having a mounting means for mounting a deformable body of the deflection sensor so as to project outwardly from the base portion, a spherical hollow cavity in the base portion, a cover having a hollow bore for accommodating therein the body of the deflection sensor and having a spherical outer surface for mating with the spherical hollow cavity of the base portion and for rolling thereon consequent to deformation of the deflection sensor, and fixing means for fixedly mounting the cover to the base portion so as to shield the deflection sensor.

BRIEF DESCRIPTION OF THE DRAWINGS

In order to understand the invention and to see how it may be carried out in practice, a preferred embodiment will now be described, by way of non-limiting example only, with reference to the accompanying drawings, in which:

FIGS. 2 and 3 show, respectively end elevations in the directions II—II and III—III in FIG. 1;

FIG. 4 is a pictorial representation of a perimeter fence employing a plurality of deflection sensors enveloped in housings according to the invention;

DETAILED DESCRIPTION OF PREFERRED EMBODIMENTS

Figure 1:
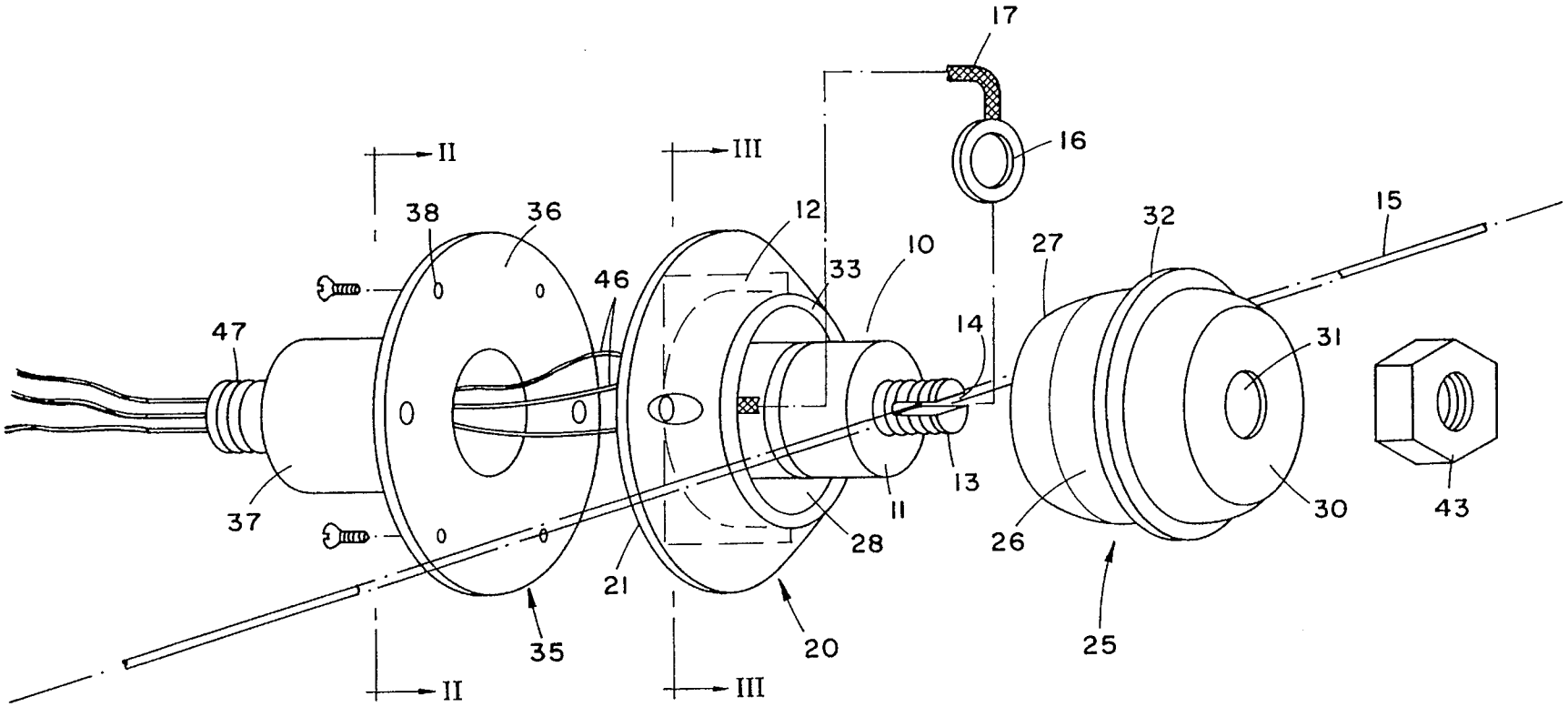
FIG. 1 shows an exploded perspective view of a housing according to a first embodiment of the invention for use with a known type of deflection sensor.

Referring to FIGS. 1, 2 and 3, there is shown a deflection sensor depicted generally as 10 having a flexible body 11 connected at one end to a plain support member 12 and having projecting therefrom a threaded rod 13 having a slot 14 therein for accommodating a fence wire 15. A metal washer 16 having a flexible copper braid 17 crimped or welded thereto is mounted on the threaded rod 13 for reasons which will be described below.

In use, the deflection sensor 10 is completely enveloped in a metallic housing depicted generally as 20 and comprising a base portion 21 having a planar rear surface 22 in which there is disposed substantially centrally a rectangular recess 23 for accommodating therein the support member 12 of the deflection sensor 10. The base portion 21 is also provided with a central aperture 24 for accommodating therethrough the body 11 of the deflection sensor 10 such that the deflection sensor 10 is mounted to the base portion 21 by pushing the flexible body 11 through the aperture 24, aligning the support member 12 with the rectangular recess 23 and thereafter screwing the support member 12 to the base portion 21 of the housing 20.

The housing 20 also comprises a cover depicted generally as 25 having a hollow bore 26 for accommodating therein the body 11 of the deflection sensor 10 and having a spherical outer surface 27 for mating with a spherical hollow cavity 28 in the base portion 21 surrounding the body 11 of the deflection sensor 10. An end surface 30 of the cover 25 is provided with a centrally threaded aperture 31 such that the end surface 30 constitutes a locking ring for threadably coupling to the threaded rod 30 so as to fixedly mount the cover 25 to the base portion 21 and so shield the deflection sensor 10.

Over-tightening the cover 25 on to the threaded rod 13 limits the deformation which can be applied to the deflection sensor 10 and so reduces its overall sensitivity. In use, it is important that the deflection sensor 10 be free to distort although such distortion should, preferably, be limited so that the elastic limit of the deflection sensor 10 is not exceeded. To this end, in use, the cover 25 must not be overly tightened, thereby allowing the spherical outer surface 27 of the cover 25 to roll within the spherical cavity 28 of the base portion 21. A peripheral rim 32 surrounds the cover 25 for engaging an outer surface 33 of the base portion 21 when the deflection sensor 10 is deformed, thereby preventing further deformation thereof. Thus, the peripheral rim 32 constitutes a limiting means for limiting movement of the cover 25 and so limiting deformation of the deflection sensor 10.

In the specific case that the deflection sensor 10 is of the kind described in the opening section of the specification having a strain gauge circuit board projecting through the support member 12, this results in the strain gauge circuit board (not shown) being exposed behind the base portion 21 to stray electromagnetic radiation.

In order to envelop the projecting portion of the deflection sensor 10, there is also provided a rear cover depicted generally as 35 and having a planar back portion 36 for engaging the rear surface 22 of the base portion 21. Projecting from the back portion 36 is a hollow cap member 37 for accommodating therein the projecting rear section of the deflection sensor 10. The back portion 36 is fixed to the planar rear surface 22 of the base section 21 by means of peripheral apertures 38 around both the base portion 21 and the back portion 36 whereupon the two may be screwed together. To this end, one set of apertures 38 may be internally threaded if desired.

In order to prevent moisture entering the housing 20 between the mating rear surface 22 of the base member 21 and the back portion 36 of the rear cover 35, one of the mating surfaces, e.g. the rear surface 22 of the base portion 21, is provided with a circumferential groove 39 for accommodating therein an "O" ring (not shown) so that when the two surfaces are screwed together, a moisture-tight seal is formed therebetween. Furthermore, in order to ensure that the threaded rod 13 is at the same electrical potential as the housing 20 itself, the flexible copper braid 17 is threaded through a small gap (not shown) between the base member 21 of the housing 20 and the support member 12 of the deflection sensor 10 mounted thereto and is then secured to the housing 20. This ensures that the threaded rod 13 is at the same electrical potential as the housing 20 itself and thereby avoids the creation of stray loop currents.

FIG. 4 shows pictorially part of a security perimeter fence 40 comprising a plurality of upright posts 41 each having a number of apertures disposed at corresponding heights therein each for accommodating therethrough the cap member 37 of the rear section 35, such that corresponding ones of the deflection sensors on each of the posts 41 are in substantially horizontal alignment. Each of the deflection sensors 10 is mounted to the post 41 by screwing the housing 20 to the post 41 through at least two of the peripheral apertures 38 in the housing. A fence wire 42 is stretched taut between the deflection sensors 10, being accommodated therein within the slot 14 within the respective threaded rods 13 and is then locked on to the threaded rod 13 via an external nut 43 (shown in FIG. 1).

In order to provide monitoring of such a security perimeter fence 40, a monitoring and alarm system (shown in FIGS. 7 and 8) must be coupled to each of the deflection sensors 10. To allow connection to the monitoring and alarm system, there is provided an electrical termination 45 which is coupled via electrical wires 46 to a socket 47 (constituting an electrical coupling means) projecting from an end surface 48 of the hollow cap member 37. In order to prevent seepage of moisture between the rear section 35 and the post 41 of the security perimeter fence 40, there is provided in a mating surface 49 of the rear section 35 a circumferential groove 50 surrounding the cap portion 37 for accommodating therein a "O" ring (not shown) so that when the projecting cap portion 37 is pushed through the aperture in the post 41 and the rear section 35 is secured thereto, seepage of moisture is prevented.

In a preferred embodiment reduced to practice, all components of the housing are formed of aluminum although it will be appreciated that the invention relies on the principle of "Faraday's cage" and any suitable electrically conductive housing conforming to the invention may be employed.

Figure 5:
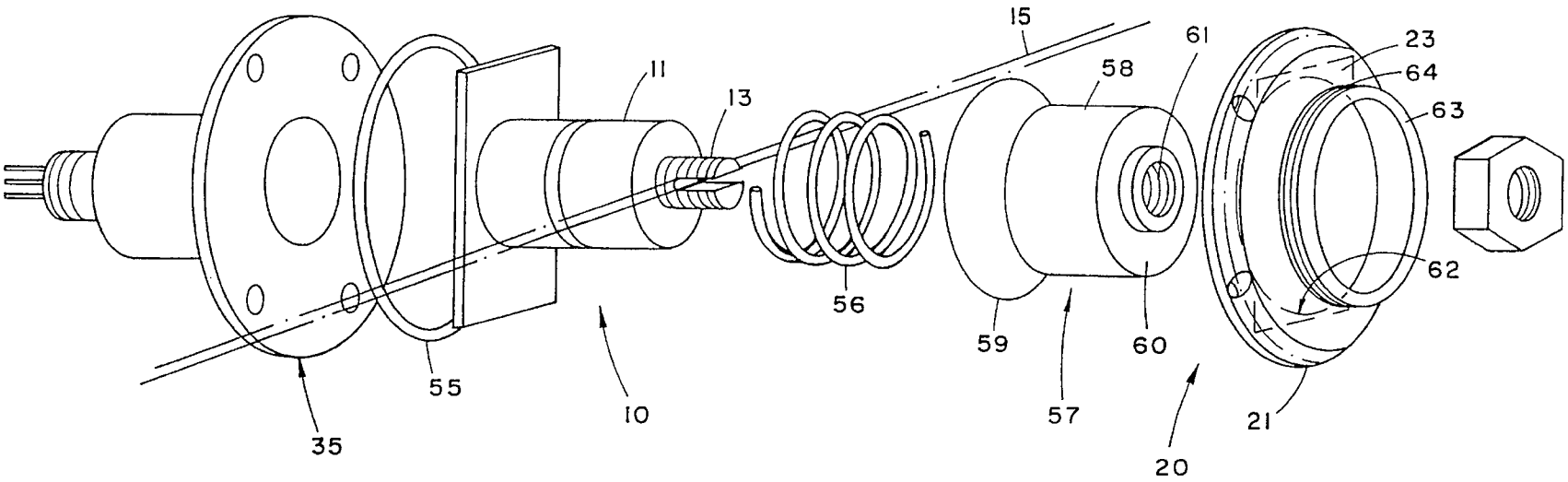
FIG. 5 shows an exploded perspective view of a housing according to a second embodiment of the invention.

FIG. 5 shows, in an exploded view, an alternative embodiment of a metallic housing according to the invention for accommodating therein a deflection sensor. To the extent that similar components appear in both embodiments, identical reference numerals will also be employed.

Thus, FIG. 5 shows a deflection sensor 10 enveloped within a housing depicted generally as 20 and comprising a base member 21 sealingly mounted in conjunction with the rear cover 35 by means of an "O" ring 55. A stiff coil spring 56 having an internal diameter slightly greater than an external diameter of the body 11 of the deflection sensor 10 is mounted on the body 11, whereupon the body 11 of the deflection sensor 10 is accommodated within a cover depicted generally as 57 and comprising a hollow aluminum cylindrical body portion 58 depending from a lower end of which is a spherical skirt portion 59. An upper end 60 of the body 58 is closed except for a central, threaded aperture 61 which permits the cover 57 to be screw-mounted on to the threaded rod 13, after first locating the coil spring 56 thereon, so that as the cover 57 is tightened on the threaded rod 13, the coil spring 56 is compressed.

An inside surface of the base member 21 of the housing 20 is provided with a rectangular recess 23 and a central generally spherical bore 62 for engaging the spherical skirt portion 59 of the cover 57. Thus, when the housing 20 is completely assembled and the base member 21 is secured to the rear cover 35, swivelling of the cover 57, consequent to deformation of the deflection sensor 10, is rendered possible owing to the rolling of the skirt portion 59 against the inside spherical surface 62 of the base member 21.

The base member 21 is provided on an outside surface thereof with a projecting flange 63 having a peripheral groove 64 therein. The groove 64 constitutes an anchoring means which allows for a weatherproof sheath (not shown) to be mounted over the projecting flange 63 and anchored thereto, so as to prevent the entry of water or moisture into the housing 20. This feature is particularly important in the event that the deflection sensor must be completely immersed in water.

In the arrangement shown in FIG. 5, force applied to the threaded rod 13 causes deformation of the deflection sensor 10 and consequent swivelling or rolling of the cover 57 within the housing 20. However, the maximum deflection of the deflection sensor 10 is limited to the extent that when the wall of the body portion 58 starts to make contact with the projecting flange 63, further rotation of the deflection sensor 10 is prevented thereby ensuring that the elastic limit thereof is not exceeded and so increasing its reliability. The coils spring 56 returns the deflection sensor 10 to its equilibrium position upon termination of short transient forces, such as wind or birds, for example, so that the resulting transient deflections are not construed as attempted intrusions.

Figure 6:
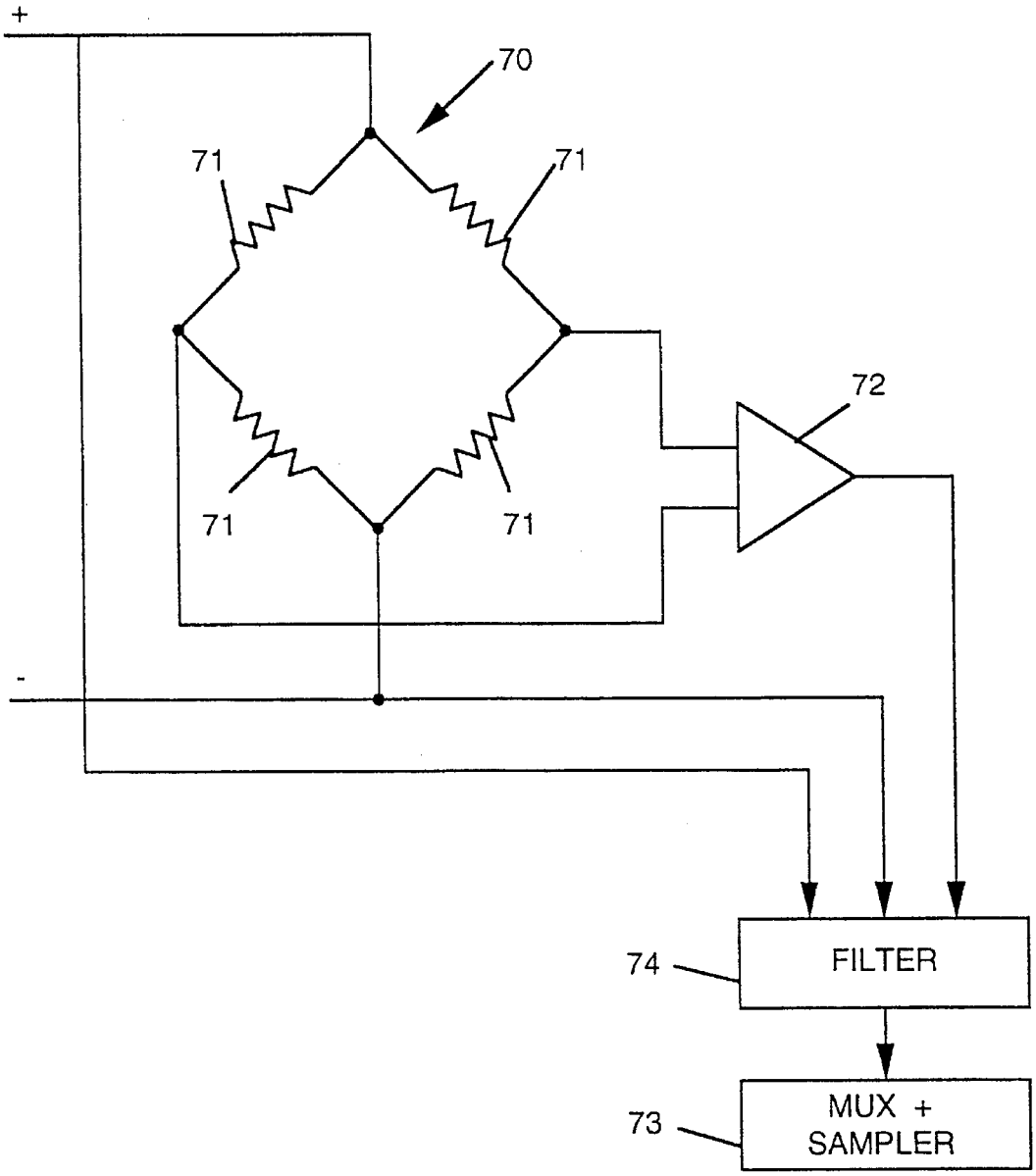
FIG. 6 is a schematic circuit diagram showing the principle of measurement of deflection used by the deflection sensor shown in FIGS. 1 and 5.

Referring to FIG. 6 there is shown a circuit diagram of a conventional Whetstone bridge circuit 70 employing four strain gauges 71. D.c. voltage is applied across one pair of opposite diagonals of the bridge circuit 70, whilst the other pair of opposite diagonals are fed to corresponding inputs of a comparator 72 which, in turn, is fed to a multiplexer and sampler 73 via a filter 74. It is to be noted that the bridge circuit 70, comprising the four strain gauges 71, is accommodated on a printed circuit board which is mounted at the rear of the deflection sensor 10 shown in FIGS. 1 and 5 and is enclosed within the rear cover 35 of the housing 20.

Figure 7:
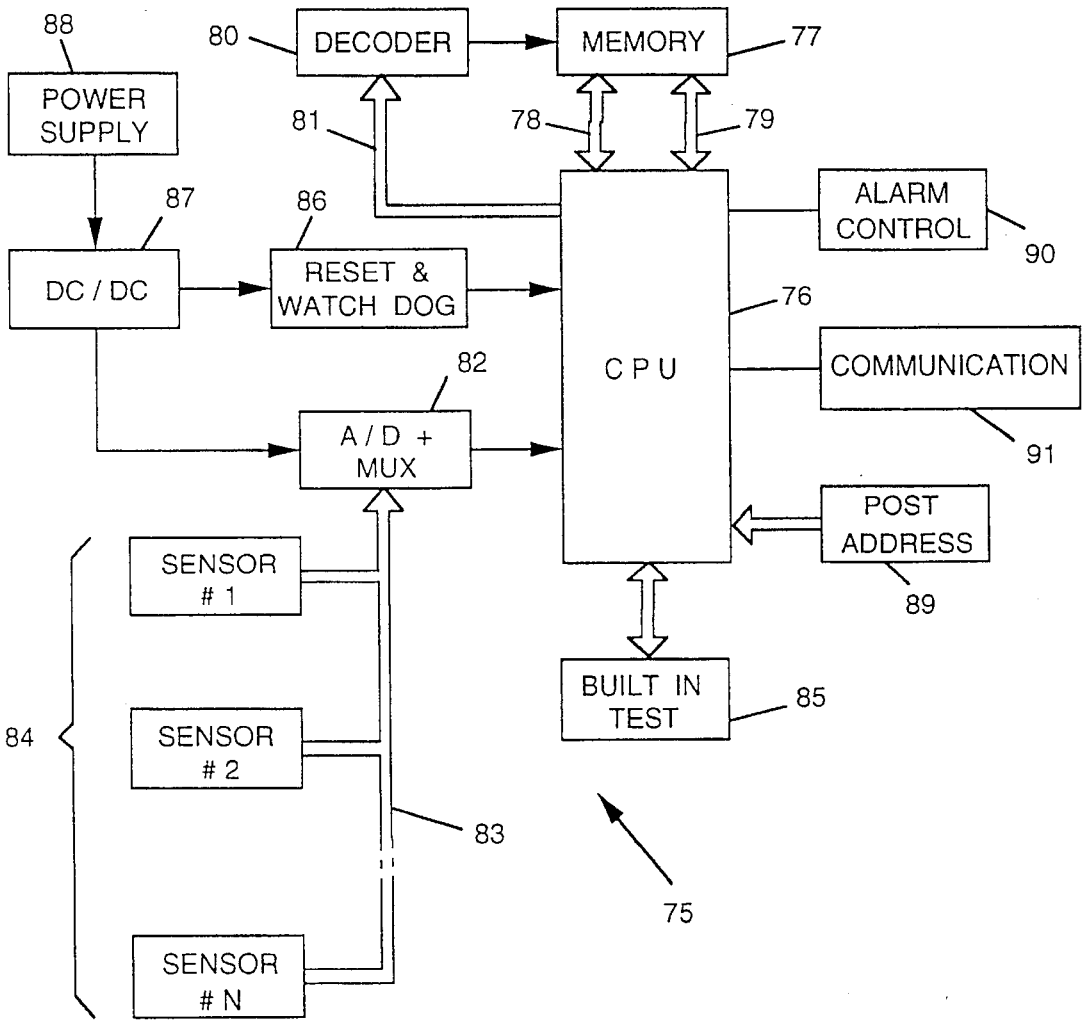
FIG. 7 is a block diagram showing functionally the main components in a perimeter fence security system according to the invention.

FIG. 7 is a block circuit diagram showing functionally the principal components of a security fence alarm system depicted generally as 75 for use with the arrangement described above with reference to FIG. 4 of the drawings. At the heart of the alarm system 75 is a central processing unit (CPU) 76 having coupled thereto a non-volatile memory 77, such as EEPROM, via data and address buses 78 and 79, respectively. The non-volatile memory 77 is responsively coupled to a decoder 80 which is itself coupled to the CPU 76 via an address line 81. Also coupled to the CPU 76 is an A/D Converter and Multiplexer 82 having an input data bus 83 coupled to a plurality of sensors 84 mounted on the fence posts 41 as shown in FIG. 4.

Associated with the CPU 76 is a Built-In Test program 85 and a Reset and Watchdog circuit 86 which perform conventional functions associated with microprocessors as will be familiar to those skilled in the art. The A/D Converter and Multiplexer as well as the Reset and Watchdog circuit 86 are powered via a d.c/d.c. converter 87 connected to a conventional d.c. power supply 88.

Also applied as an input to the CPU 76 is a post address 89 permitting the address of a fence post 41 to be supplied thereto in order to check the status of the deflection sensors mounted thereon. An alarm control 90 and a communications interface 91 are connected to the CPU 76 for respectively operating an alarm responsive to an alarm condition detected by the CPU 76, and for effecting communication between the CPU 76 and the sensors 84 and with a security company responsible for the security of the system.

In the arrangement shown in FIG. 7 each of the sensors 84 is connected to the CPU 76, in turn, via the A/D Converter and Multiplexer 82 so that the corresponding deflection of each sensor can be sampled in accordance with the arrangement shown in FIG. 6. In the event that one or more of the deflection sensors is deflected beyond a permitted threshold value, this is indicative of an attempted intrusion and an alarm is given.

Figure 8:
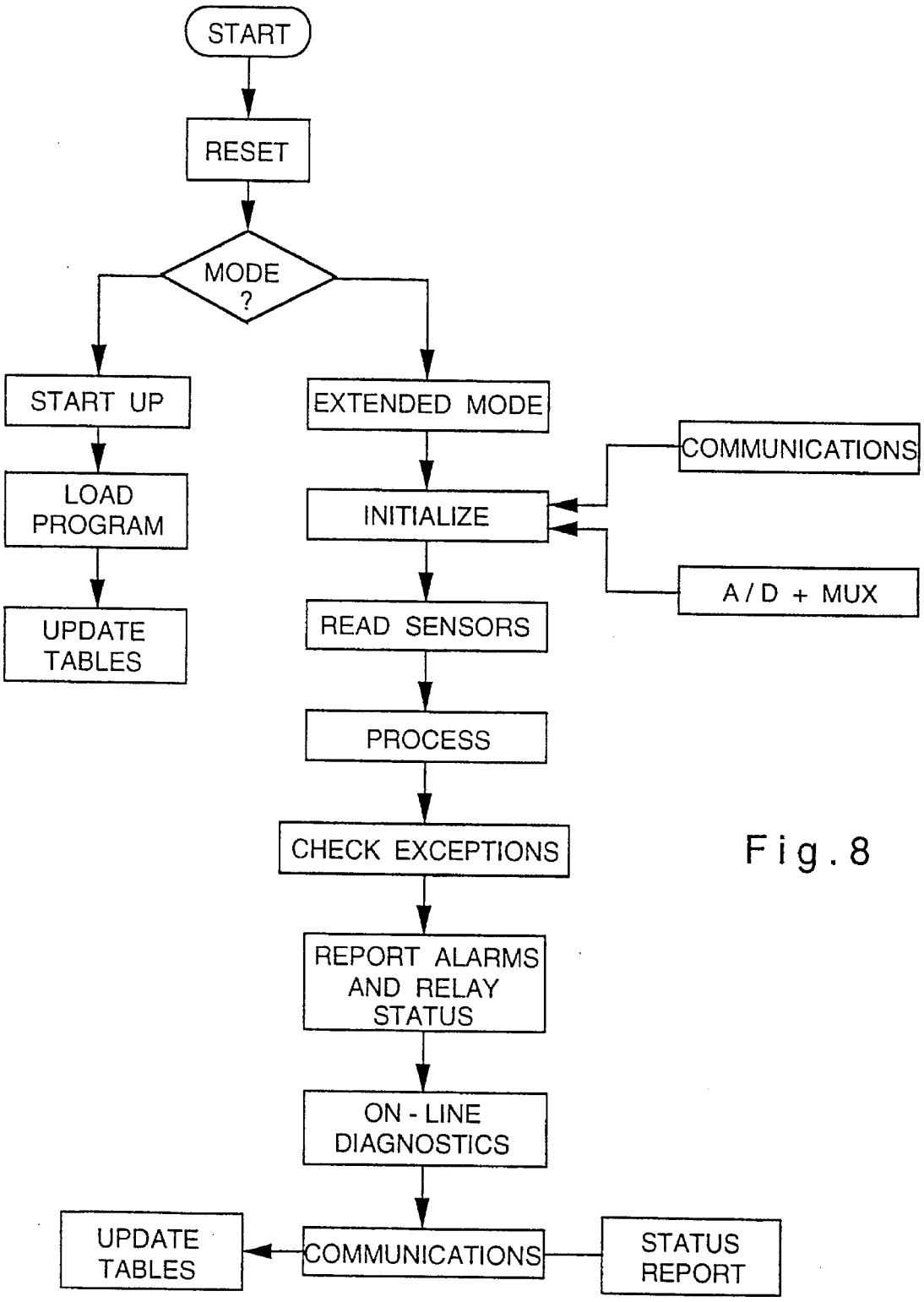
FIG. 8 is a flow diagram showing the principal operating steps associated with the security system of FIG. 7.

FIG. 8 shows, in more detail, the principal operating steps associated with the CPU 76 shown in FIG. 7. Initially, the CPU 76 is reset and then one of two alternative modes of operation is executed. Thus, initially, when the system 75 is switched on for the first time, a start-up mode is initiated whereby the program is loaded and an internal table showing the deflection of each of the sensors 85 is updated. The deflections are digitally encoded between 0 and 255 so as to be represented by an 8-bit binary word, or byte. Were no force at all to be applied to the deflection sensors 84, then the nominal equilibrium position would correspond to a deflection of 128. However, in practice, it is arranged that even when no external force is applied to the perimeter fence, each of the deflection sensors 85 is nevertheless slightly deformed so as to have an equilibrium deflection which is close to, but not equal to 128. This is done because, if it were known that the deflection sensors on adjacent fence posts in equilibrium were subjected to zero deformation, then an intruder could cut the connecting fence wire without changing the status of either of the deflection sensors. However, by arranging, as is done in the invention, that the equilibrium deflection is never zero, then cutting the inter-connecting fence wire between adjacent fence posts will ensure that a net change in the deformation of the deflection sensors always occurs.

Once the system is set up and all of the internal tables are updated with the equilibrium deflections of all of the deflection sensors, then a so-called extended mode of operation is undertaken for as long as the system is in operation. The communications interface as well as the A/D Converter and Multiplexer are initialized whereupon each of the sensors in turn is read and processed. Exceptional deformations are checked according to predetermined criteria in order to determine whether such exceptions correspond to alarm conditions. If so, then a suitable alarm is provided. The CPU 76 is also programmed to perform on-line diagnostics and, of course, constantly to calculate new average deflections, to update the deflection tables accordingly and to provide periodic status reports, as required.

Although perimeter fence security systems are known in the art, there are several novel features associated with the system according to the invention which should be noted. First, as has already been explained, the equilibrium positions of the deflection sensors are so arranged that there is applied to each deflection sensor a non-zero force resulting in a net deformation.

Furthermore, there are defined a start window and a drift window which allow a range of acceptable deflections to be defined such that only if the deflections are outside the corresponding "windows" will an alarm be given. Thus, denoting:

$D_O$=the average zero deflection,

SW=the start window, and $D_p$=the range of permitted deflections then:

$$D_O-SW<D_p<D_O+Sw.$$

The drift window functions in similar manner but provides control of the measured average deflection. Specifically, if the average deflection of any sensor changes in either direction outside of the defined drift window, this is construed as a faulty deflection sensor and appropriate monitoring and manual inspection is performed in order to replace the deflection sensor if necessary. Thus, denoting:

$D_{av}$=the average instantaneous deflection,

DW=the drift window, and $D_p$=The range of permitted deflections.

then:

$$D_{av}-DW<D_p<D_{av}+DW.$$

It should be noted that the drift window DW is always greater than the start window SW, since a greater variation between average deflections is permitted over an extended time period than at program initiation.

According to a preferred approach, the deflections are measured for all of the deflection sensors on a single post and compared in order to check whether they are all substantially in within range or whether, to the contrary, one measurement differs from the others by more than a predetermined threshold. This is done in order to differentiate between the effect of changing environmental and ambient conditions which affect all of the deflections on a single post similarly, and the effect of attempted intrusion which generally affects only one deflection sensor on the post. Specifically, for example, in a strong wind which deflects the whole of the fence post equally, it is to be expected that the resultant deflections on each deflection sensor will be substantially equal. It may well be that, owing to the strong wind force, the measured changes in the deflections themselves will greatly exceed the normal safe level thereby suggesting the possibility of intrusion, but their overall equality overrides this consideration and prevents the emission of a false alarm.

In a preferred embodiment of the invention, the communications interface is based on an asynchronous protocol such as RS232 or RS422. It will, however, be readily appreciated that this and other features are optional and are easily changed according to specific design preferences without departing from the spirit of the invention.

The invention thus provides, in the first instance, a housing for completely enveloping a deflection sensor whilst nevertheless allowing restricted deformation thereof so as to negate the effects of radiation. The invention also encompasses within its scope a perimeter fence alarm system using such a deflection sensor.

Figure 9:
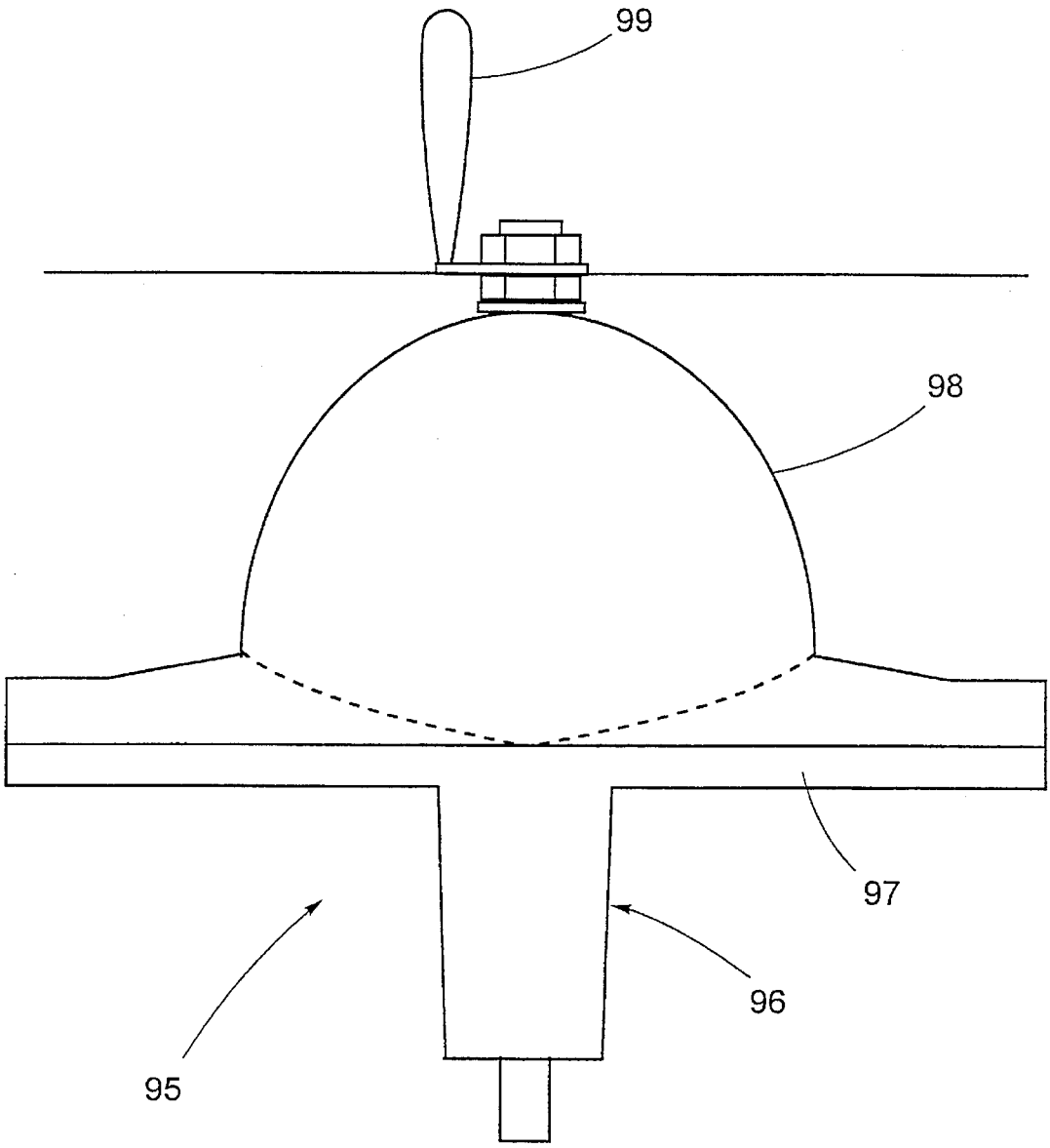
FIG. 9 is a pictorial representation of a joystick enveloped in a housing according to the invention.

However, it will be appreciated that whilst the preferred embodiment relates to a deflection sensor, in general the invention finds application wherever it is required to screen an electronic component or circuit from electromagnetic radiation, whilst permitting movement of the electronic component. Thus, the invention may also be employed for use with a joystick, for example, where free rotation thereof must be allowed. FIG. 9 shows such a joystick depicted generally as 95 enveloped in a metallic housing shown generally as 96 and comprising a base portion 97 and semi-spherical cover 98 adapted for spherical rolling movement within the base portion 97 as explained above with reference to FIGS. 1 to 3 of the drawings. The joystick 95 is fixedly mounted to the cover 98 so that movement of the cover 98 operates the joystick 95 in the normal manner. Such movement is effected by means of a handle 99 fixed to an outer surface of the cover 98. Likewise, the electronic component may be a taut wire sensor and a security fence of the type described may be constructed using such a sensor. Other applications will likewise be apparent to those skilled in the art.

I claim:

1. An electrically conductive housing for completely enveloping an electronic component so as to screen the electronic component from electromagnetic radiation whilst permitting spherical rolling movement of the electronic component relative to the housing when acted upon by an external force.

2. The housing according to claim 1, comprising:

a base portion having a mounting means for mounting a deformable body of the electronic component so as to project outwardly from the base portion, a spherical hollow cavity in the base portion, a cover having a hollow bore for accommodating therein the body of the electronic component and having a spherical outer surface for mating with the spherical hollow cavity of the base portion and for rolling thereon consequent to deformation of the electronic component, and fixing means for fixedly mounting the cover to the base portion so as to shield the electronic component.

3. The housing according to claim 2, wherein the spherical hollow cavity is provided in an external surface of the base portion.

4. The housing according to claim 3, further including a limiting means for restricting movement of the cover within the base member and so limiting deformation of the electronic component.

5. The housing according to claim 4, wherein the limiting means comprises a peripheral rim surrounding the cover for engaging an outer surface of the base member.

6. The housing according to claim 2, wherein the spherical hollow cavity is provided in an internal surface of the base portion, and the cover comprises:

a hollow substantially right circular cylindrical body closed at one end thereof and having depending from an opposite end a spherical skirt portion.

7. The housing according to claim 6, further including a coil spring mounted within the body of said cover for restoring the body of the electronic component to an initial position in the absence of said external force.

8. The housing according to claim 2, wherein the fixing means comprises a threaded rod projecting from the body of the electronic component through an aperture in the cover and a threaded locking member for engaging said rod.

9. The housing according to claim 8, wherein the threaded locking member is an end surface of the cover.

10. The housing according to claim 2, wherein the body of the electronic component is cylindrical and the mounting means comprises:

a planar support member for supporting the body of the electronic component so that a longitudinal axis thereof is normal to a plane of the support member, an aperture in the base member for accommodating therethrough the body of the electronic component, a recess in a rear surface of the base member for accommodating therein the support member, and fixing means for fixing the support member within said recess.

11. The housing according to claim 10, wherein the electronic component partially intersects the support member and there is further provided a rear cover for screening a projecting rear section of the electronic component, the rear cover comprising:

a planar back portion for engaging a planar rear surface of the base portion, a hollow cap member projecting outwardly from the back portion for accommodating therein the projecting rear section of the electronic component, and fixing means for fixing the back portion to the base portion.

12. The housing according to claim 11, wherein there is provided within the base portion and/or the back portion a groove for accommodating an "O" ring therein so as to seal the housing against the entry of moisture when the back portion is fixed to the base portion.

13. The housing according to claim 11, wherein:

the electronic component is a deflection sensor having a rear projecting section which terminates in an electrical termination, and an electrical coupling means is fixed to an end surface of the hollow cap member for electrically coupling to the electrical termination.

14. The housing according to claim 11, further including a circumferential groove in the back portion surrounding an outer surface of the projecting hollow cap member for accommodating therein an "O" ring.

15. The housing according to claim 2, wherein the body of the deflection sensor includes a coupling means for coupling thereto to a security fence wire so that, in use, distortion of said wire causes deformation of the deflection sensor.

16. The housing according to claim 15, wherein:

the fixing means comprises a threaded rod projecting from the body of the deflection sensor through an aperture in the cover and a threaded locking member for engaging said rod, and the coupling means comprises a slot formed in an end of the threaded rod for accommodating therein the security fence wire and a locking nut for engaging the threaded rod.

17. The housing according to claim 1, wherein the electronic component is a joystick.

18. The housing according to claim 1, wherein the electronic component is a deflection sensor.

19. The housing according to claim 1, including anchor means for anchoring thereto a moisture-proof sheath so as to prevent the entry of moisture into the housing.

20. The housing according to claim 1, wherein the electronic component is a taut wire sensor.

21. A security fence comprising:

a plurality of upright posts each having a number of apertures disposed at corresponding heights therein for accommodating therethrough the housing according to claim 15, each of said housings being fixedly attached to the post, and a like number of wires each stretched between matching ones of said housings for fixedly engaging the coupling means of the respective deflection sensor.

22. The security fence according to claim 21, further including an alarm system coupled to each of the deflector sensors for monitoring a corresponding average deflection thereof and providing an alarm if the average deflection changes by more than a predetermined threshold.

23. The security fence according to claim 22, wherein the alarm system includes:

a memory for storing therein a table of average deflections of each of the deflection sensors, processing means coupled to the memory for processing the average deflections so as to determine an alarm condition, and alarm means coupled to the processing means and responsive to said alarm condition for providing an alarm.

24. The security fence according to claim 23, wherein the processing means includes means for comparing each of the average deflections with a start threshold so as to check whether the average deflection is within an acceptable start window, according to the formula:

$$D_O-SW<D_p<D_O<SW$$

where:

$D_O$=the average zero deflection,

SW=the start window, and $D_p$=the range of permitted deflections.

25. The security fence according to claim 23, wherein the processing means includes means for comparing each of the average deflections with a prior value in order to determine a drift in average deflection for each deflection error so as to check that the drift in average deflection conforms to the formula:

$$D_{av}-DW<D_p<D_{av}+DW$$

where:

$D_{av}$=the average instantaneous deflection,

DW=the drift window, and $D_p$=the range of permitted deflections.

26. The security fence according to claim 23, wherein the processing means includes:

post addressing means for addressing a fence post having a specific address so as to measure the average deflections of all of the deflection sensors on said fence post, comparator means coupled to the post addressing means for comparing the average deflections of each of said deflection sensors and producing a match signal if any differences between the average deflections are less than a predetermined threshold regardless of their absolute magnitudes, and disabling means coupled to the comparator means and to the alarm means and being responsive to said match signal for disabling the alarm means.

27. The security fence according to claim 21, wherein an equilibrium position of each of the deflection sensors corresponds to a deformation thereof.

* * * * *